US006073364A

United States Patent [19]

McKenzie et al.

[11] Patent Number: 6,073,364

[45] Date of Patent: Jun. 13, 2000

[54] WIPER FOR A FLOOR SWEEP ASSEMBLY OF A GRAIN DRYER WHICH INCLUDES ULTRA-HIGH MOLECULAR WEIGHT RESIN WHICH CONTACTS GRAIN AND GRAIN SHELF FLOOR DURING ROTATION THEREOF

[75] Inventors: Terry L. McKenzie; Paul W. Peterson, both of Indianapolis; Wesley L. Peterson, DeMotte, all of Ind.

[73] Assignee: ffi Corporation, Indianapolis, Ind.

[21] Appl. No.: 09/124,305

[22] Filed: Jul. 29, 1998

Related U.S. Application Data

[60] Provisional application No. 60/054,171, Jul. 30, 1997.

[51] Int. Cl.[7] ..... F26B 17/12

[52] U.S. Cl. ..... 34/166; 34/173

[58] Field of Search ..... 34/359, 360, 366, 34/367, 368, 369, 371, 380, 381, 386, 397, 400, 165, 166, 167, 172, 173, 179; 414/294, 301, 305, 306, 307, 308, 309, 313, 326, 808

[56] References Cited

U.S. PATENT DOCUMENTS

| | | | |
|---|---|---|---|
| 3,009,689 | 11/1961 | Hinz | 34/173 |
| 3,713,564 | 1/1973 | Cottrell . | |
| 3,833,137 | 9/1974 | Mathews . | |
| 4,004,351 | 1/1977 | Sanneman et al. | 34/168 X |
| 4,020,561 | 5/1977 | Mathews . | |
| 4,036,613 | 7/1977 | Brown et al. | 55/294 |
| 4,183,430 | 1/1980 | Hunter . | |
| 4,189,262 | 2/1980 | Anderson . | |
| 4,217,701 | 8/1980 | Mathews | 34/211 |
| 4,630,382 | 12/1986 | Keiler et al. | 34/173 |
| 5,039,827 | 8/1991 | Harmon . | |
| 5,566,470 | 10/1996 | Morrison | 34/167 |
| 5,860,221 | 1/1999 | Morrison et al. | 34/167 |

OTHER PUBLICATIONS

Marketing brochure from Grain Systems, Inc., 1004 E. Illinois Street, Assumption, IL 62510, Published prior to Jul. 30, 1997.

Marketing brochure from Kan–Sun® Grain Dryers, Mathews Company, Crystal Lake, IL 60014, Published prior to Jul. 30, 1997.

Blueprint entitled, "Grain Discharge Metering Mechanism", Published prior to Jul. 30, 1997.

Blueprint entitled, "Installing Drives & Metering Screws", Published prior to Jul. 30, 1997.

Blueprint entitled, "Typical Metering Mechanism", Published prior to Jul. 30, 1997.

Blueprint entitled, "Idler Gear Positioning", Published prior to Jul. 30, 1997.

Marketing brochure entitled "Zimmeran: The Innovator of Time–Proven Commercial Grain Dryers", printed on Mar. 1996 by Zimmerman a Division of ffi Corporation, 5900 Elmwood Ave., Indianapolis, Indiana 46203–6086.

*Primary Examiner*—Stephen Gravini
*Attorney, Agent, or Firm*—Maginot, Addison & Moore

[57] ABSTRACT

A grain dryer includes a wall assembly having (i) an inner wall and an outer wall which defines a grain flow path therebetween, and (ii) a discharge slot defined in the wall assembly through which grain may flow. The grain dryer further includes a grain shelf floor positioned relative to the wall assembly such that grain flowing through the discharge slot advances onto the grain shelf floor, the grain shelf floor has a hopper opening defined therein. The grain dryer additionally includes a floor sweep assembly having a wiper, wherein (i) the wiper includes a blade support and a blade attached to the blade support, (ii) the floor sweep assembly is positioned vertically above the grain shelf floor such that rotation of the floor sweep assembly causes grain positioned on the grain shelf floor to be pushed across an upper surface of the grain shelf floor by the blade until the grain falls through the hopper opening, and (iii) a first lower edge of the blade contacts the grain shelf floor so as to slide across the upper surface of the grain shelf floor as the floor sweep assembly is being rotated. A method for advancing grain across a grain shelf floor of a grain dryer with a floor sweep assembly is also disclosed.

4 Claims, 10 Drawing Sheets

WIPER FOR A FLOOR SWEEP ASSEMBLY OF A GRAIN DRYER WHICH INCLUDES ULTRA-HIGH MOLECULAR WEIGHT RESIN WHICH CONTACTS GRAIN AND GRAIN SHELF FLOOR DURING ROTATION THEREOF

This application claims the benefit of U.S. Provisional Application Ser. No. 60/054,171, filed Jul. 30, 1997. The disclosure of U.S. Provisional Application Ser. No. 60/054,171 is herein incorporated by reference.

CROSS REFERENCE

Cross reference is made to copending U.S. patent applications Ser. No. 09/124,308, entitled "Floor Sweep Assembly for a Grain Dryer having Primary Support Members and Ancillary Support Members which Form a Number of Intersections with a Wiper" by Terry L. McKenzie, Paul W. Peterson, and Wesley L. Peterson Ser. No. 09/124,307, entitled "Floor Sweep Assembly for a Grain Dryer having Support Members and Wipers which are Spaced Apart from each other by Spacing Members at Intersections Formed Therebetween" by Terry L. McKenzie, Paul W. Peterson, and Wesley L. Peterson, and Ser. No. 09/124,306, entitled "Grain Dryer having Motor for Rotating Floor Sweep Assembly which is Mounted Above Cooling Floor" by Terry L. McKenzie, Paul W. Peterson, and Wesley L. Peterson, all of which are assigned to the same assignee as the present invention, and all of which are filed concurrently herewith.

BACKGROUND OF THE INVENTION

The present invention relates generally to grain dryers which utilize heated air to reduce the moisture content of harvested grain such as corn, beans, wheat, and oats.

In order to store grain for a long period of time, it is necessary to dry the grain to a condition in which it is less subject to molding or other deterioration. Accordingly, numerous types of grain dryers have heretofore been designed which possess a number of grain flow channels defined between a pair of perforated walls. Grain is advanced through these grain flow channels while at the same time heat is passed through the perforated walls. This process results in heating of the grain which is flowing through the grain flow channels thereby reducing the moisture content of the grain. Reducing the grain's moisture content enables the grain to be stored for a long period of time without molding or otherwise deteriorating.

Defined within the lower portion of the perforated walls of the above type of grain dryer, there exists a number of discharge slots through which grain advances after being subjected to the above-described moisture reduction process. One type of grain dryer which has heretofore been designed provides a grain shelf floor which receives the grain flowing out through the discharge slots.

The grain shelf floor has a hopper opening defined in a center portion of the grain shelf floor. Thereafter, a grain metering system which includes a number of augers advances the grain from the outer portion of the grain shelf floor to the hopper opening. Once the grain reaches the hopper opening, the grain falls into a discharge hopper located under the hopper opening. The discharge hopper directs the grain to a discharge auger thereby removing the grain from the grain dryer.

One challenge when designing grain dryers is to obtain a grain metering system which is durable yet relatively inexpensive to manufacture. Another challenge when designing grain dryers is to obtain a grain metering system which accurately meters the grain into the discharge hopper at a desired rate. Yet another challenge when designing grain dryers is to obtain a grain metering system which has a relatively low horsepower requirement for the motor of the grain metering system. In addition, another challenge when designing grain dryers is to obtain a grain metering system that protects the motor of the grain metering system from being contaminated by grain dust. Still another challenge when designing grain dryers is to obtain a grain metering system which does not cause damage to the grain as the grain is metered into the discharge hopper. Yet another challenge when designing grain dryers is to obtain a grain metering system which does not cause damage to the grain shelf floor during operation of the grain metering system.

SUMMARY OF THE INVENTION

According to one embodiment of the present invention, there is provided a grain dryer which includes a wall assembly having (i) an inner wall and an outer wall which defines a grain flow path therebetween, and (ii) a discharge slot defined in the wall assembly through which grain may flow. The grain dryer further includes a grain shelf floor positioned relative to the wall assembly such that grain flowing through the discharge slot advances onto the grain shelf floor, the grain shelf floor has a hopper opening defined therein. The grain dryer additionally includes a floor sweep assembly having a wiper, wherein (i) the wiper includes a blade support and a blade attached to the blade support, (ii) the floor sweep assembly is positioned vertically above the grain shelf floor such that rotation of the floor sweep assembly causes grain positioned on the grain shelf floor to be pushed across an upper surface of the grain shelf floor by the blade until the grain falls through the hopper opening, and (iii) a first lower edge of the blade contacts the grain shelf floor so as to slide across the upper surface of the grain shelf floor as the floor sweep assembly is being rotated.

According to another embodiment of the present invention, there is provided a floor sweep assembly for advancing grain across a grain shelf floor of a grain dryer. The floor sweep assembly includes a wiper having a blade support and a blare attached to the blade support, wherein (i) rotation of the floor sweep assembly causes grain positioned on the grain shelf floor to be pushed across an upper surface of the grain shelf floor by the blade, and (ii) a first lower edge of the blade contacts the grain shelf floor so as to slide across the upper surface of the grain shelf floor as the floor sweep assembly is being rotated. The floor sweep assembly further includes a support member, wherein rotation of the support member causes rotation of the wiper.

Yet according to another embodiment of the present invention, there is provided a method for advancing grain across a grain shelf floor of a grain dryer with a floor sweep assembly, wherein (i) the floor sweep assembly includes a wiper, and (ii) the wiper includes a blade support and a blade attached to the blade support. The method includes the steps of (i) moving the blade into contact with grain supported on the grain shelf floor so as to push the grain across an upper surface of the grain shelf floor, and (ii) maintaining a space between the blade support and the grain shelf floor during the blade moving step.

According to still another embodiment of the present invention, there is provided a method for advancing grain within a grain dryer. The method includes the steps of (i) advancing grain onto a grain shelf floor of the grain dryer, and (ii) moving a blade into contact with the grain supported on the grain shelf floor so as to push the grain across an upper surface of the grain shelf floor, wherein the blade includes a resin material which contacts the grain during the blade moving step.

One object of the present invention is to provide a new and useful grain dryer.

Another object of the present invention is to provide an improved grain dryer.

Still another object of the present invention is to provide a new and useful floor sweep assembly for a grain dryer.

Yet another object of the present invention is to provide an improved floor sweep assembly for a grain dryer.

Still another object of the present invention is to provide a new and useful method of advancing grain across a grain shelf floor of a grain dryer with a floor sweep assembly.

Another object of the present invention is to provide an improved method of advancing grain across a grain shelf floor of a grain dryer with a floor sweep assembly.

Yet another object of the present invention is to provide a floor sweep assembly which is durable yet relatively inexpensive to manufacture.

Still another object of the present invention is to provide a floor sweep assembly which accurately meters the grain into the discharge hopper at a desired rate.

Yet another object of the present invention is to provide a floor sweep assembly which rotates easily during operation of the grain dryer thereby placing a relatively low horsepower requirement on the motor of the grain metering system of the grain dryer.

Still another object of the present invention is to provide a grain dryer that protects the motor of the grain metering system of the grain dryer from being contaminated by grain dust.

Yet another object of the present invention is to provide a floor sweep assembly which does not cause damage to the grain as the grain is metered into the discharge hopper.

Still another object of the present invention is to provide a floor sweep assembly of a grain metering system which does not cause damage to the grain shelf floor during operation of the grain metering system.

Other objects and benefits of the present invention can be discerned from the following description and accompanying drawings.

DESCRIPTION OF THE PREFERRED EMBODIMENT

Figure 1:
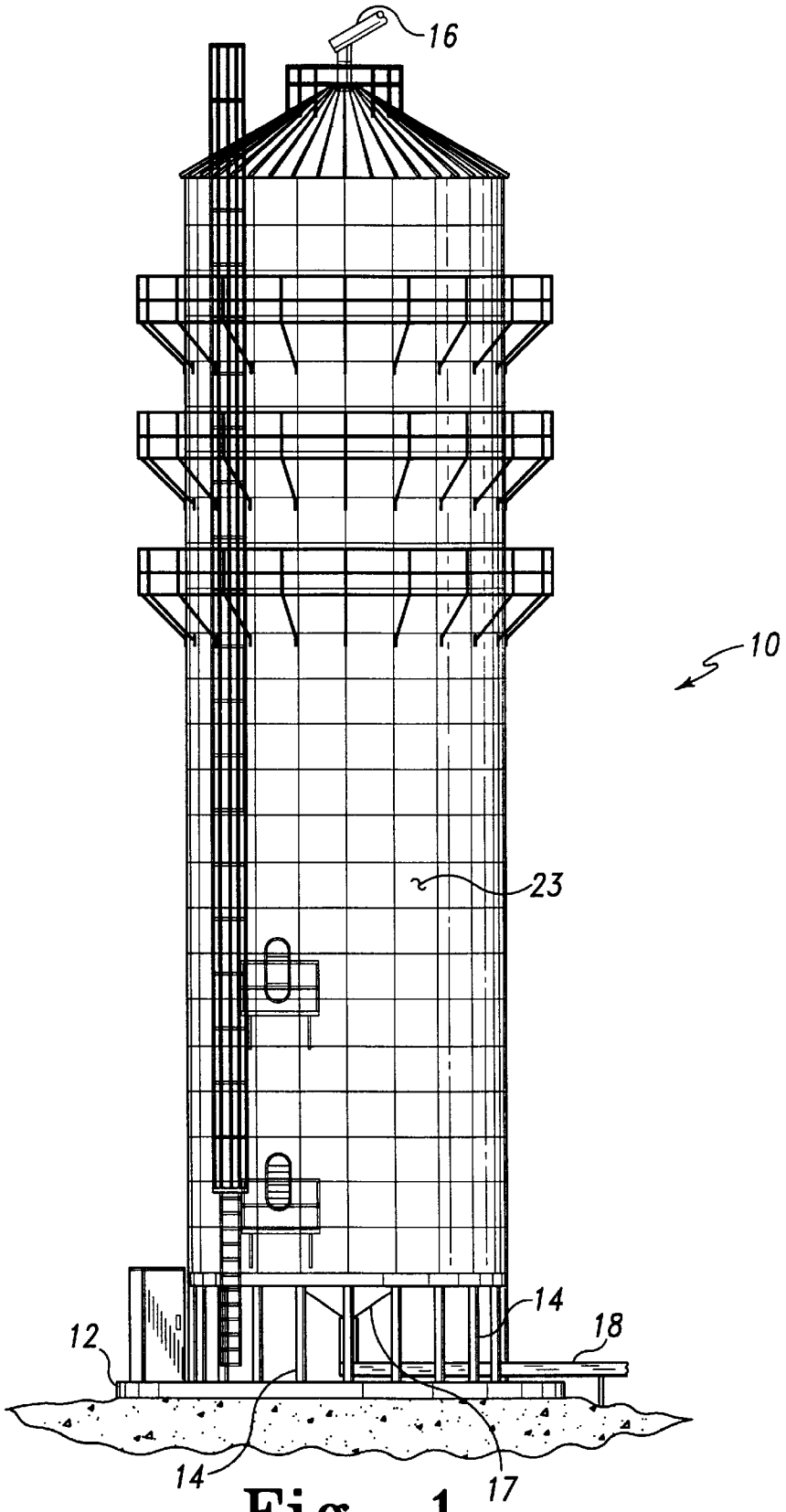
FIG. 1 is a side elevational view of a grain dryer which incorporates the features of the present invention therein.

For the purposes of promoting an understanding of the principles of the invention, reference will now be made to the embodiments and methods illustrated in the drawings and specific language will be used to describe the same. It will nevertheless be understood that no limitation of the scope of the invention is thereby intended, such alterations and further modifications in the illustrated devices and methods, and such further applications of the principles of the invention as illustrated therein being contemplated as would normally occur to one skilled in the art to which the invention relates.

Referring now to the drawings, FIG. 1 shows a grain dryer 10 which is supported on a concrete pad 12. The grain dryer 10 includes a number legs 14 which extend into the concrete pad 12. The grain dryer further includes an inlet conduit 16, a hopper 17, and an outlet conduit 18. Grain is advanced into the grain dryer 10 through the inlet conduit 16. Thereafter, grain advances through the grain dryer 10 where it is heated to reduce its moisture content. After the grain's moisture content is reduced, the grain is advanced into the hopper 17 and out of the grain dryer through the outlet conduit 18 thereby allowing it to be received for long term storage in a storage unit such as a silo. Types of grain which may be dried by dryer 10 include corn, beans, wheat, and oats.

Figure 2:
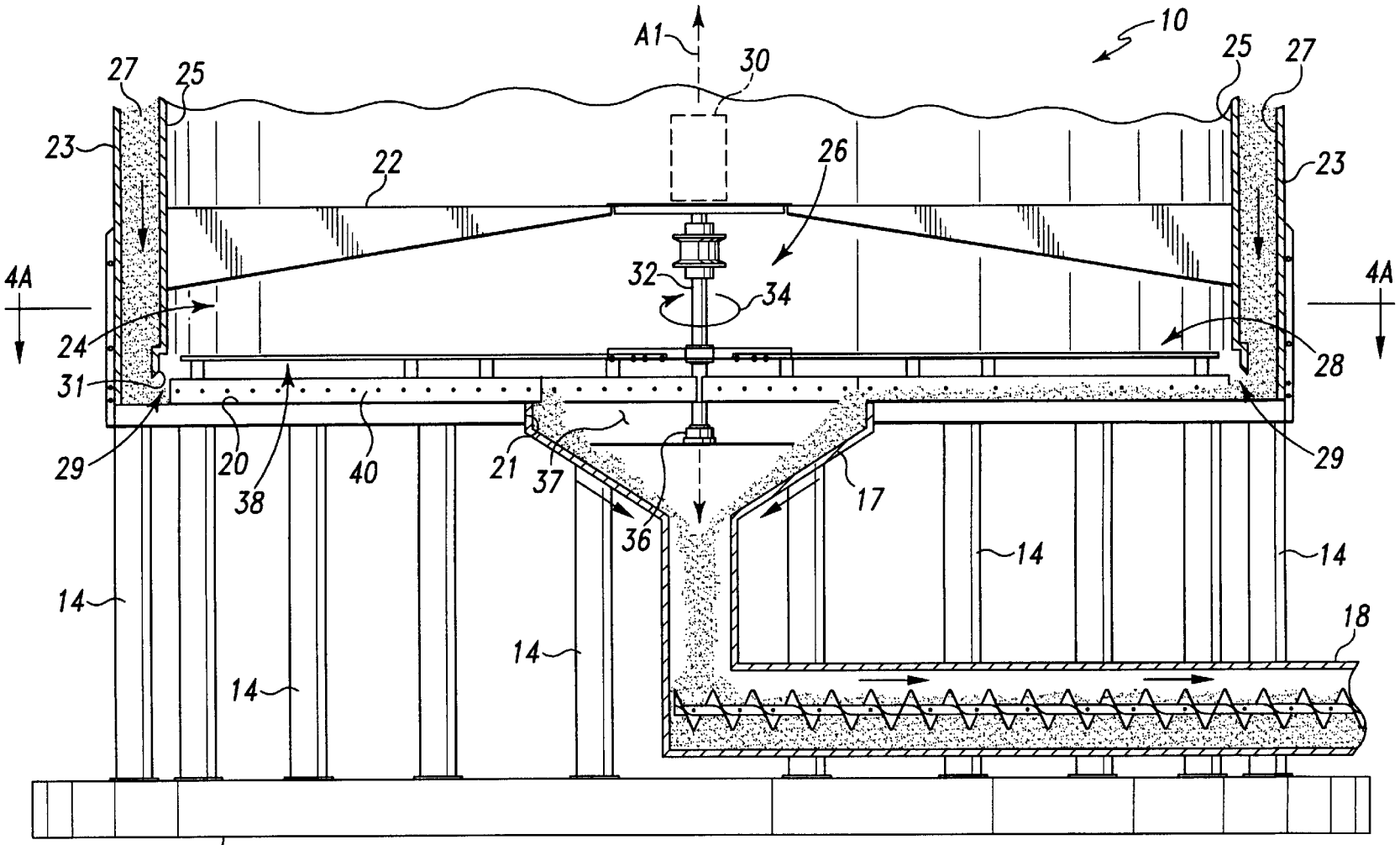
FIG. 2 is a cross sectional view of a lower portion of the grain dryer of FIG. 1.
Figure 3:
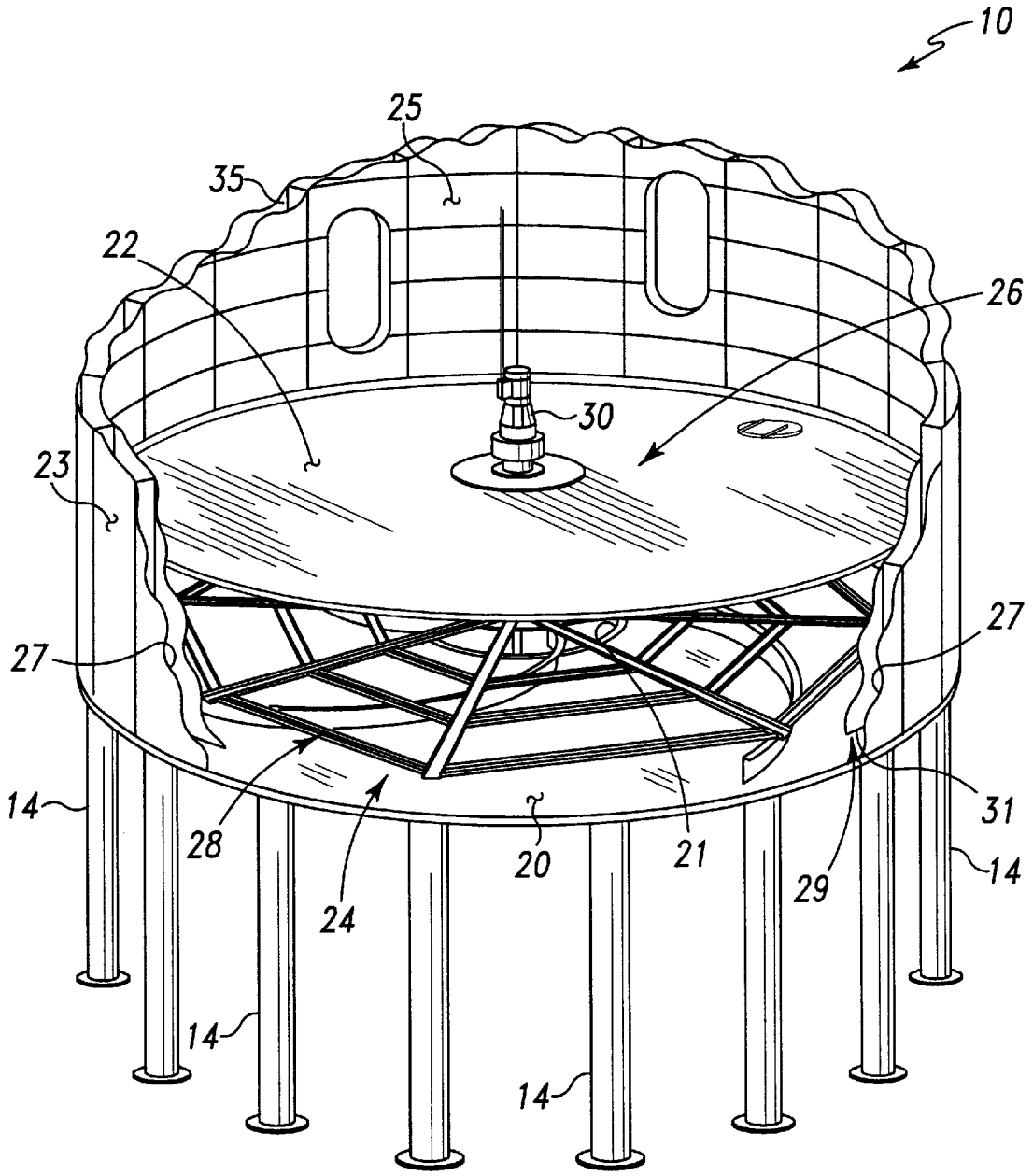
FIG. 3 is a fragmentary perspective view of a lower portion of the grain dryer of FIG. 1.
Figure 5:
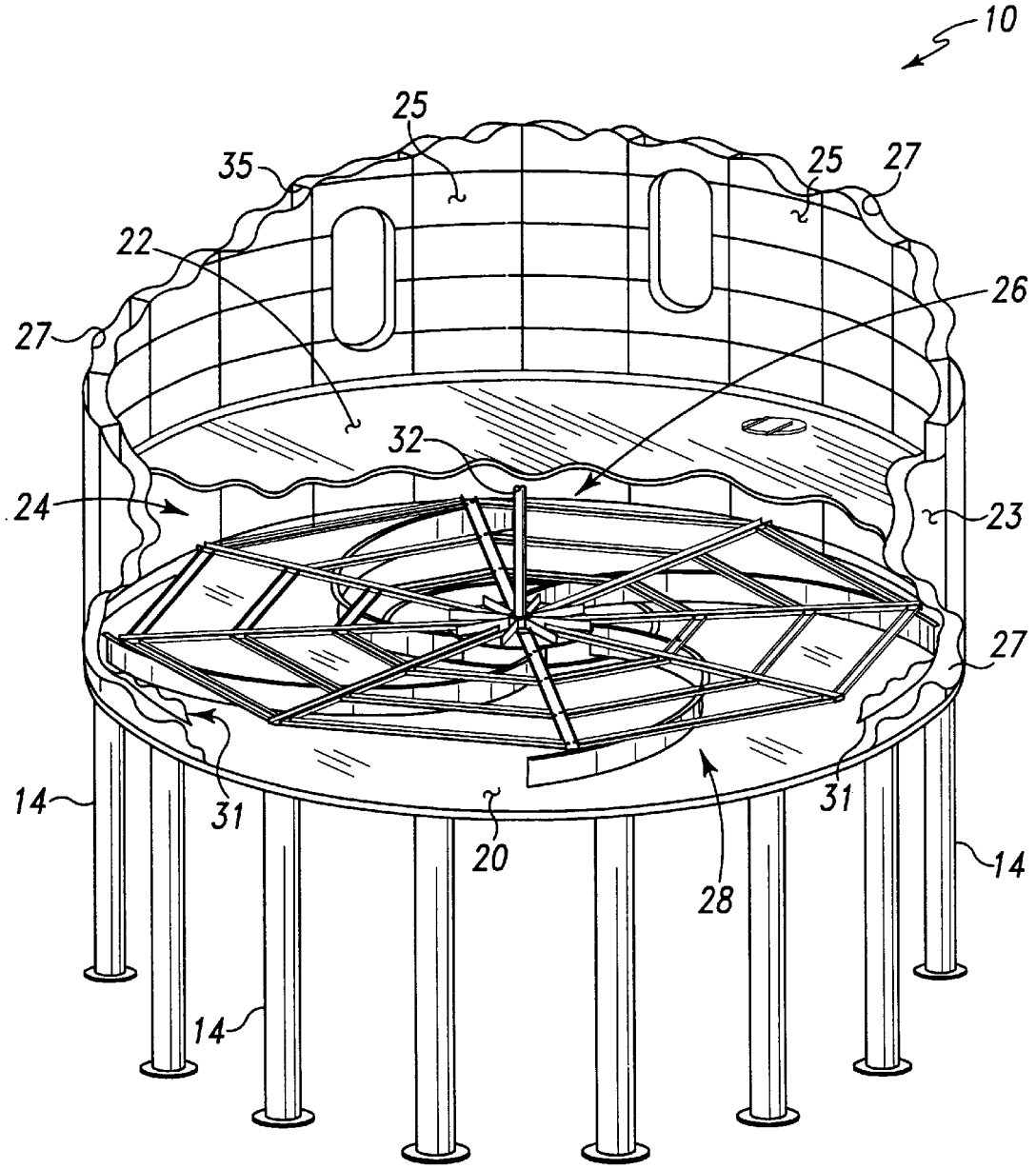
FIG. 5 is a view similar to FIG. 3 but showing a portion of the cooling floor and additional portions of the inner and outer perforated walls of the grain dryer removed for clarity of description.

Turning now to FIGS. 2, 3, and 5, a lower portion of the grain dryer 10 is shown in more detail. The grain dryer 10 includes a grain shelf floor 20 and a cooling floor 22 which define a sweep space 24 therebetween. The cooling floor 22 is positioned vertically above the grain shelf floor 20. The grain shelf floor 20 is circular in shape and is positioned in a substantially horizontal orientation. Similarly, the cooling floor 22 is circular in shape and is positioned in a substantially horizontal orientation. In addition, the cooling floor 22 is positioned in a substantially parallel orientation in relation to the grain shelf floor 20. Both the grain shelf floor 20 and the cooling floor 22 are made from galvanized sheet steel. A hopper opening 21 is defined in a center portion of the grain shelf floor 20.

The grain dryer 10 further includes an outer wall 23 and an inner wall 25 which collectively define a number of grain flow channels or paths 27 therebetween. A number of partitions 35 define the lateral sides of the grain flow channels 27. Both the outer wall 23 and the inner wall 25 are perforated as is well known in the art in order to allow heated air to traverse the grain flow channels 27 and heat the grain flowing therein. The space defined by the grain flow channels 27 constitutes a drying space in which the grain traveling through this space is dried (i.e. its moisture content is reduced).

A grain discharge slot 29 is defined between a lower end 31 of the inner wall 25 and the grain shelf floor 20 as shown in FIGS. 2, 3, and 5. After dried grain reaches the lower end of the grain flow channels 27, it exits the grain discharge slot 29 and is advanced onto an outer peripheral portion of the grain floor shelf 20 as shown in FIG. 2. Thereafter, a grain metering system 26 transports the grain from the outer peripheral portion of the grain shelf floor 20 to the hopper opening 21 defined in the center portion of the grain shelf floor 20.

A grain metering system 26 is positioned in the lower portion of the grain dryer 10. In particular, the grain metering system 26 includes a floor sweep assembly 28 which is located within the sweep space 24. The grain metering system further includes a motor 30 which has a drive shaft 32 which is mechanically coupled to the floor sweep assembly 28. Operation of the motor 30 results in clockwise rotation of drive shaft 32 (indicated by arrow 34 in FIG. 2). The drive shaft 32 extends downwardly from the motor 30 through the hopper opening 21 and terminates in a lower end portion 36 which is supported by a support bar 37 which is mounted within the hopper 17. The lower end portion 36 of the drive shaft 32 is located vertically below the grain shelf floor 20.

The motor 30 illustratively includes an electric motor and a Sumitomo Machinery Corporation of America SM-CYCLO® speed reducer assembly. This combination provides substantial speed reduction in a relatively small package. It is designed to reduce substantially the likelihood of a catastrophic failure, and to withstand substantial shock loads. The flexibility provided by the number of different gear ratios available for this style motor permits its use with a number of different dryer sizes and unloading speed specifications. The motor's power supply (not shown) is also continuously monitored, providing additional protection against overloading. A Browning GRID-FLEX™ coupling located between the drive shaft 32 and the floor sweep assembly 28 accommodates minor misalignment of the motor 30 and the floor sweep assembly 28, and permits the floor sweep assembly 28 to "float" on the grain shelf floor 20.

The motor 30 is mounted on the cooling floor 22 at a position vertically above the cooling floor 22 as shown in FIGS. 2 and 3. With this mounting arrangement, the motor 30 is located out of the sweep space 24. It should be appreciated that the sweep space 24 is a relatively small confined space whose ambient air possesses a relatively high concentration of grain dust. This grain dust is mixed into the ambient air when the grain exits the grain flow channels 27 through the grain discharge slot 29, as well as when the grain is metered by the floor sweep assembly 28 horizontally along the grain shelf floor 20 and into the hopper 17. Isolation of the motor 30 from the highly grain dust concentrated ambient air of the sweep space 24 results in enhanced operation and longevity of the motor 30. In addition, mounting of the motor 30 in the above-described manner positions the motor 30 in a region which is subjected to relatively cool recirculating air during operation of the grain dryer 10. This results in cooling of the motor 30 during its operation.

Figure 4A:
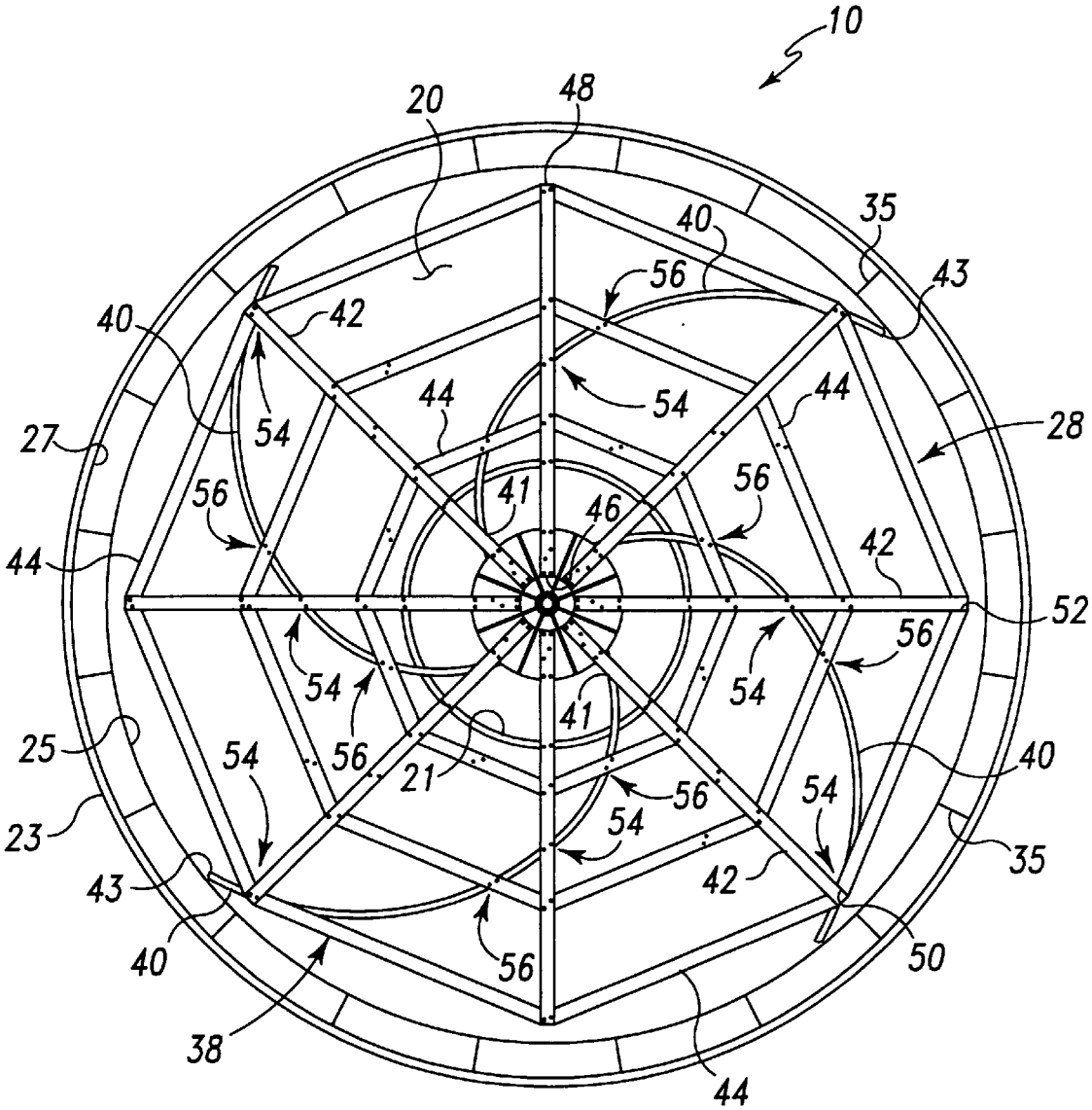
FIG. 4A is a sectional view which is taken along the line 4A—4A of FIG. 2 as viewed in the direction of the arrows, with FIG. 4A showing a plan view (or top elevational view) of a first embodiment of the floor sweep assembly of the present invention.
Figure 6A:
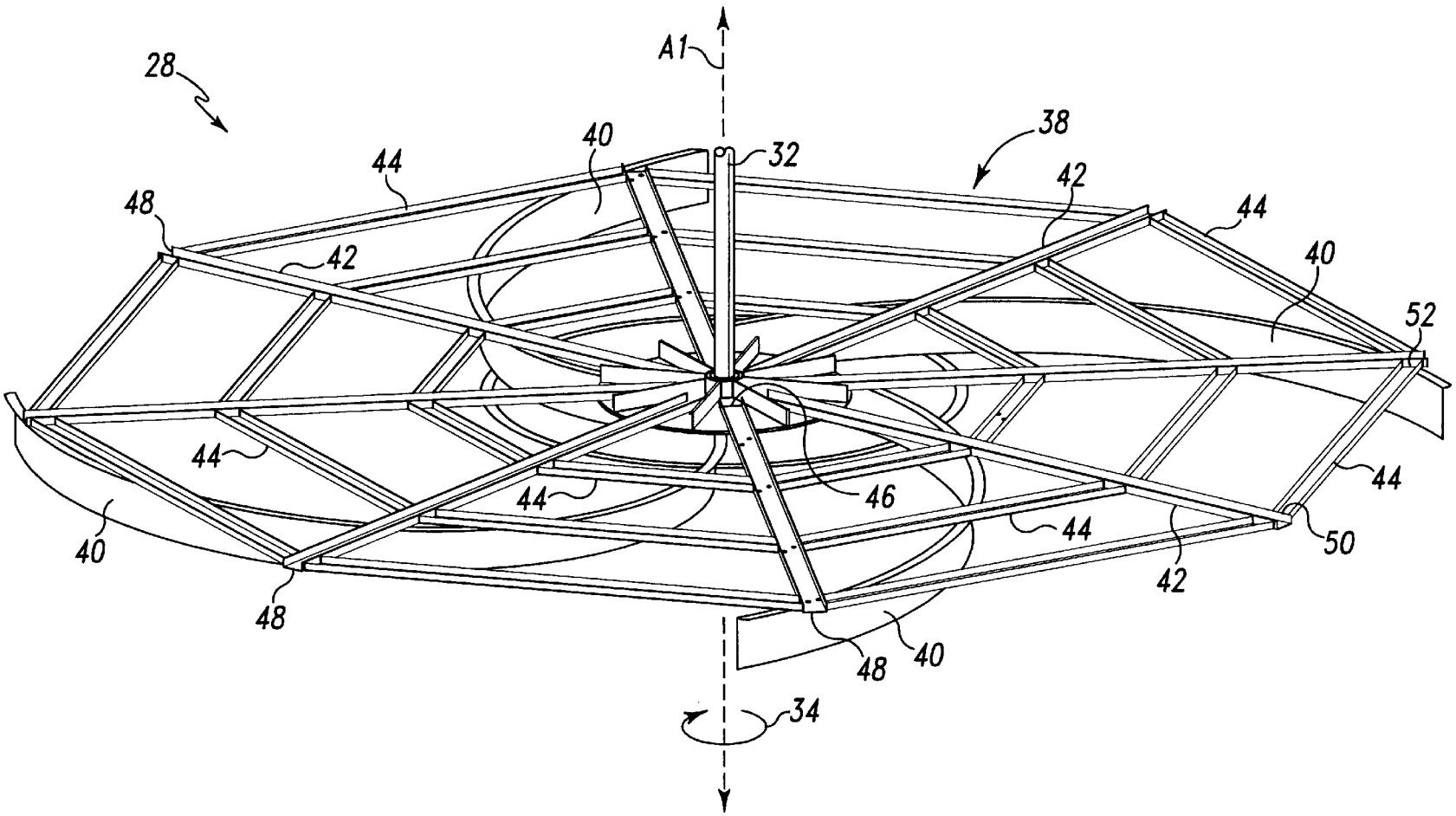
FIG. 6A is a perspective view of the first embodiment of the floor sweep assembly of the grain dryer of FIG. 1.

Referring now to FIGS. 4A and 6A, the floor sweep assembly 28 is shown in more detail. The floor sweep assembly 28 is rotatable around a central axis A1 (see FIG. 6A) after it is installed into the grain dryer 10. In particular, the drive shaft 32 of the motor 30 is mechanically coupled to the floor sweep assembly 28. During operation of the grain dryer 10, the motor 30 is driven to rotate the drive shaft 32. Rotation of the drive shaft 32 causes rotation of the floor sweep assembly 28 around the central axis A1 in the clockwise direction 34 as shown in FIG. 2.

The floor sweep assembly 28 includes a framework 38 and a number of wipers 40 each of which is secured to the framework 38. The framework 38 includes a number of primary support members 42 and a number of ancillary support members 44. Each of the primary support members 42 extend radially outwardly relative to the central axis A1 as shown in FIG. 4A. Moreover, each of the ancillary support members 44 is spaced apart from the central axis A1 and extends between a first primary support member 42 and an adjacent second primary support member 42 as shown in FIGS. 4A and 6A.

During operation of the grain dryer 10, the motor 30 is driven to rotate the floor sweep assembly 28 around the central axis A1 in the clockwise direction 34 as shown in FIG. 2. More specifically, the motor 30 is driven so as to rotate the drive shaft 32. Rotation of the drive shaft 32 causes rotation of the framework 28, which in turn cause rotation of the wipers 40 in a recirculating path of movement. Rotation of the wipers 40 in the above manner causes grain positioned on the grain shelf floor 20 to be pushed in a substantially horizontal direction across an upper surface of the grain shelf floor 20 by the wipers 40 until the grain falls through the hopper opening 21.

Each of the primary support members 42 has an inboard primary support end 46 and an outboard primary support end 48. Each of the ancillary support members 44 has a left lateral end 50 and a right lateral end 52.

Each of the wipers are secured to the framework 38 such that, when the floor sweep assembly 38 is viewed in a plan view such as in FIG. 4A, the framework 38 and the wipers 40 define a number of primary intersections 54 of the wipers 40 and the primary support members 42. The primary intersections 54 occur at locations which are interposed between inboard wiper ends 41 of the wipers 40 and outboard wiper ends 43 of the wipers 40 as shown in FIG. 4A. In addition, each of the wipers 40 are further secured to the framework 38 such that, when the floor sweep assembly 38 is viewed in the plan view as in FIG. 4A, the framework 38 and the wipers 40 define a number of ancillary intersections 56 of the wipers 40 and the ancillary support members 44. It should be noted that the primary intersections 54 and the ancillary intersection 56 provide convenient locations to secure the wipers 40 to the framework 38. Providing the floor sweep assembly 28 with a substantial number of these intersections 54, 56, results in a floor sweep assembly which is highly stable during operation of the grain dryer 10, as well as highly durable over the life span of the grain dryer.

It should be appreciated that providing the floor sweep assembly 28 with intersections that occur at locations which involve more than one primary support member (e.g. two primary support members) contributes to the above-identified stability and durability. Moreover, providing the floor sweep assembly 28 with intersections that occur at locations which involve at least one primary support member and at least one ancillary support member also contribute to the above-identified stability and durability.

Figure 4B:
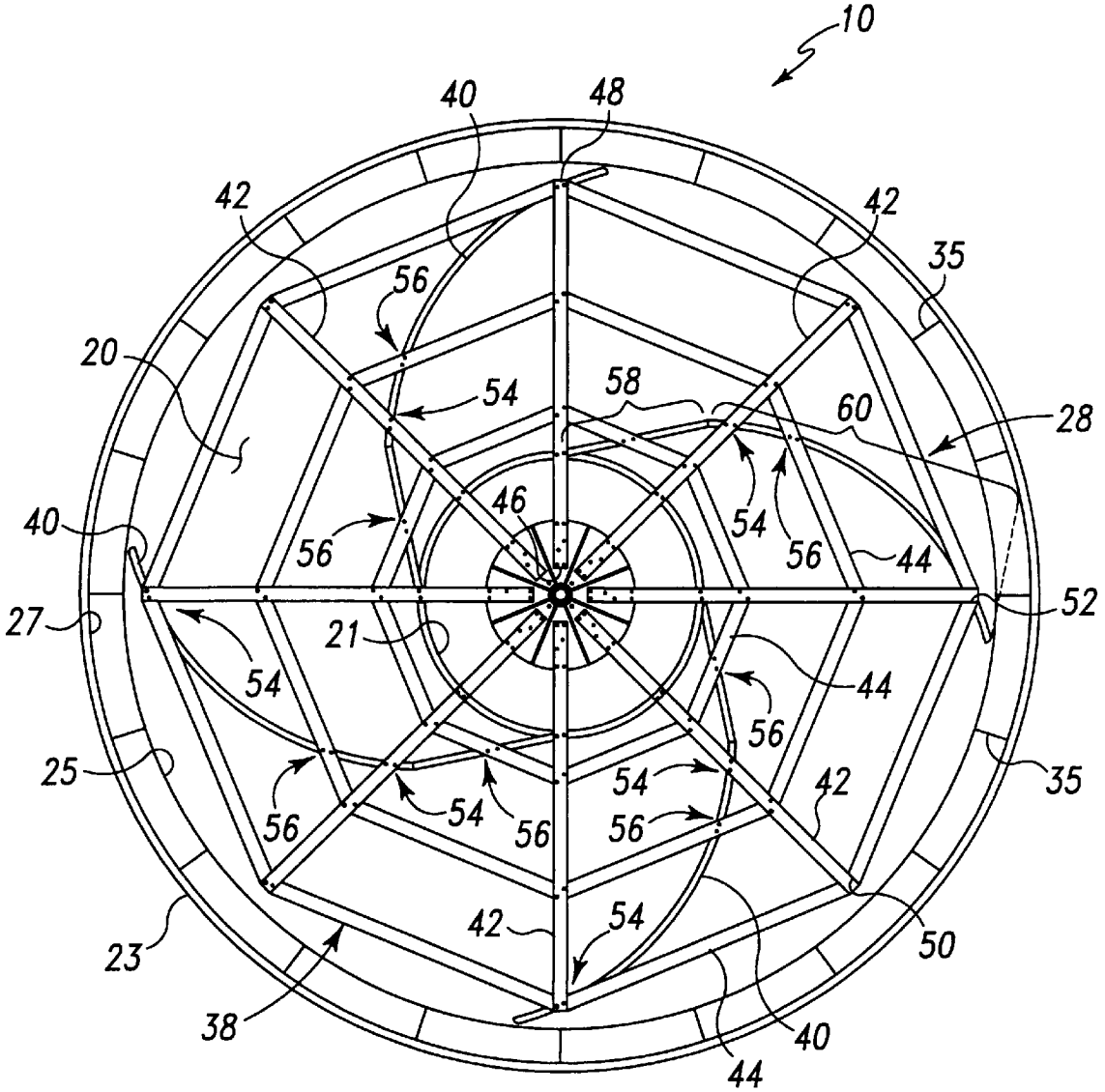
FIG. 4B is a view similar to FIG. 4A but with FIG. 4B showing a plan view (or top elevational view) of a second embodiment of the floor sweep assembly of the present invention.

FIG. 4B shows a second embodiment of the floor sweep assembly 28 which incorporates the features of the present invention therein. Reference numbers which were used to identify the various elements in FIG. 4A will be used to identified analogous elements in FIG. 4B for clarity of description. The floor sweep assembly 28 of FIG. 4B is similar to the floor sweep assembly 28 of FIG. 4A, however, one distinction exists which relates to the geometric configuration of the blades 40. In particular, each of the wipers 40 of FIG. 4A gradually curves throughout its entire length. In contrast, the wipers 40 of FIG. 4B include a linear section 58 and a curved section 60. The linear section 58 is located at an inboard portion of each wiper 40, while the curved section 60 is located at an outboard portion of each wiper 40. Another distinction between the floor sweep assembly 28 of FIG. 4A and the floor sweep assembly 28 of FIG. 4B is that the inboard portion of wipers 40 of FIG. 4B terminates near the outer peripheral edges of hopper opening 21, while the inboard portion of wipers 40 of FIG. 4A terminates a significant distance inward of the outer peripheral edges of hopper opening 21.

Figure 6B:
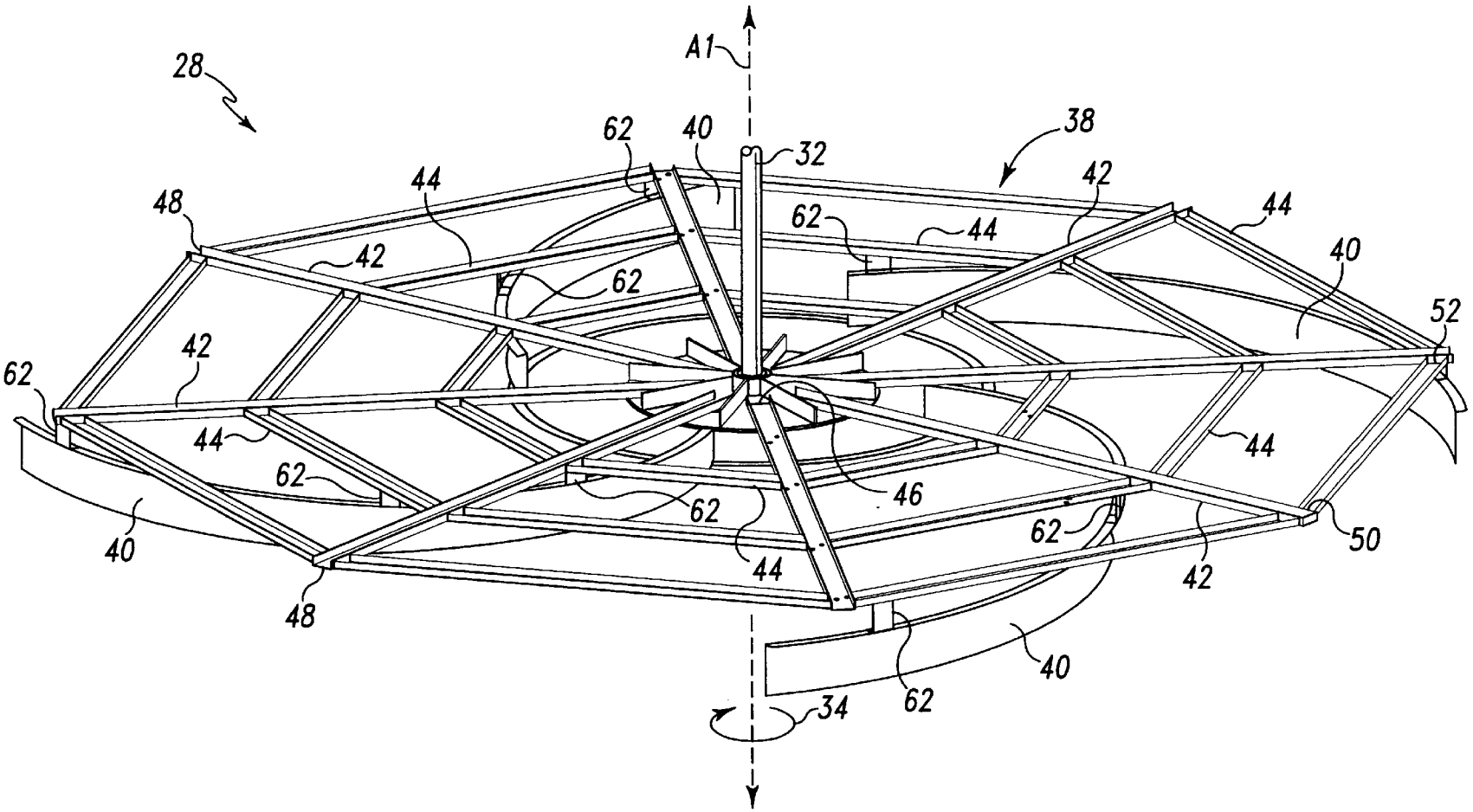
FIG. 6B is a view similar to FIG. 6A but showing a third embodiment of the floor sweep assembly of the present invention.

FIG. 6B shows a third embodiment of the floor sweep assembly 28 which incorporates the features of the present invention therein. Reference numbers which were used to identified the various elements in FIG. 4A will be used to identify analogous elements in FIG. 6B for clarity of description. The floor sweep assembly 28 of FIG. 6B is similar to the floor sweep assembly 28 of FIG. 4A, however, one distinction which exists is that the floor sweep assembly 28 of FIG. 6B includes a number of spacers 62 which are interposed between the framework 38 and the wipers 40 at various of the intersections 54, 56. Each of the spacers 62 is generally U-shaped and includes a number of fastener apertures 64 extending therethrough (see also FIGS. 9 and 10). In addition, each of the spacers 62 includes an upright wall 66 having a height of H1. Preferably, the height H1 is equal to about two inches (2") or greater. More preferably, the height H1 is equal to about four inches (4"). Thus, the closest distance between the framework 38 and any of the wipers 40 is about two inches (2") or greater. And preferably, the closest distance between the framework 38 and any of the wipers 40 is about four inches (4"). Thus, during operation of the grain dryer 10, no portion of any of the wipers 40 contacts the framework 38.

Figure 9:
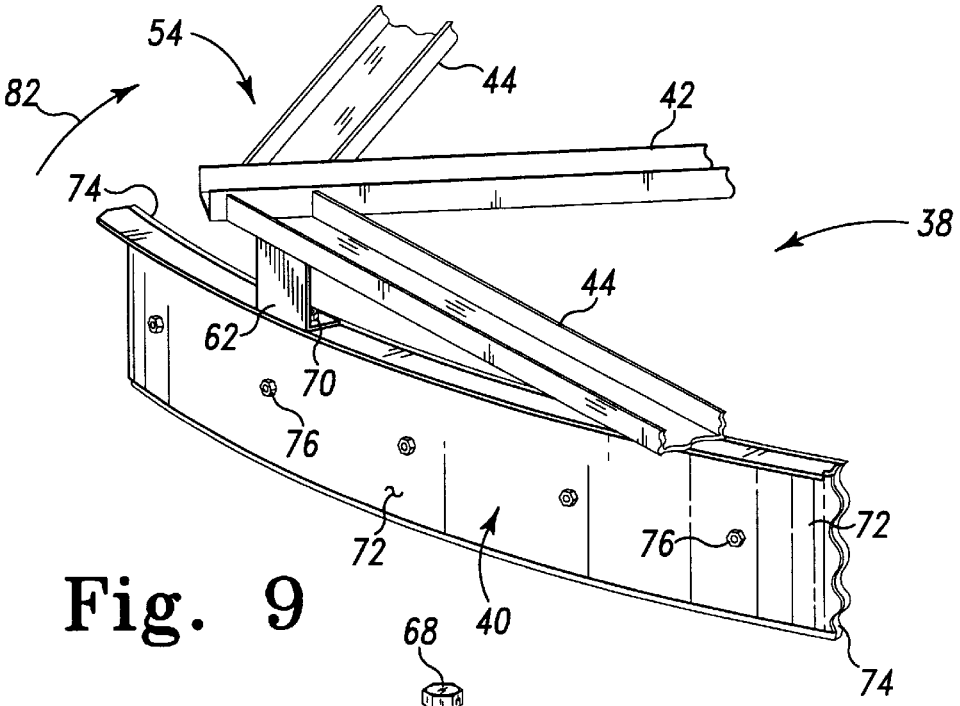
FIG. 9 is a perspective view of a portion of the floor sweep assembly of FIG. 4B showing one spacer interposed between the framework and the wiper.
Figure 10:
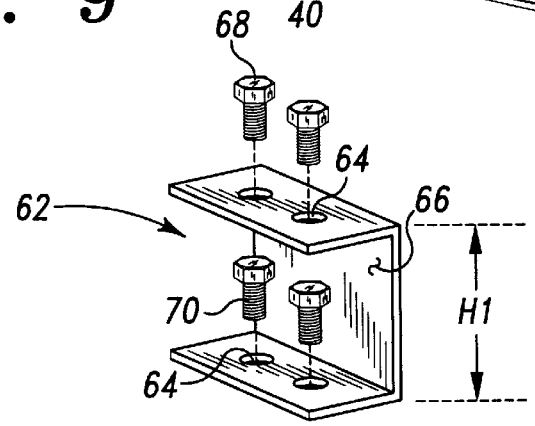
FIG. 10 is a perspective view of one of the spacers of the floor sweep assembly of FIG. 6B.

More specifically, the spacers 62 are interposed between the primary support members 42 and the wipers 40 at various primary intersections 54 in order to space the primary support members apart from the wipers 40. FIG. 9 shows a typical spacing arrangement used in this embodiment of the present invention. In particular, the spacer 62 is secured directly to the primary support member 42 with a number of fasteners 68 (see also FIG. 10). Moreover, the wiper 40 is secured directly to the spacer 62 with a number of fasteners 70.

The spacers 62 are also interposed between the ancillary support members 44 and wipers 40 at various ancillary intersections 56 in order to space the ancillary support members apart from the wipers 40. The securing of the spacers 62 at the various ancillary intersections 56 are achieved in a manner similar to that hereinbefore described with respect to securing of the spacers 62 at the various primary intersections 54.

Providing spacers 62 at various primary intersections 54 and various ancillary intersections 56 in the manner described above results in the framework 38 being spaced apart from the wipers 40 during operation the grain dryer 10. Spacing the framework 38 apart from the wipers 40 eliminates the creation of catch points between the framework 38 and wipers 40. Such catch points tend to result in plant parts such as husks, stalks, and leaves accumulating or building-up on the floor sweep assembly 28 during operation of the grain dryer 10. Accumulation of plant parts on the floor sweep assembly 28 results in a substantially increased resistance or drag being placed on the floor sweep assembly 28 during operation of the grain dryer 10 which may be detrimental to the motor 30 of the grain metering system 26. In addition, such accumulation may tend to trap a quantity of grain between such accumulation and an end portion of the wiper 40. Moving this trapped quantity of grain continuously in a recirculating path of movement also places increased resistance or drag on the floor sweep assembly 28 during operation of the grain dryer 10, as well as reducing the accuracy of the metering function performed by grain metering system 26 of the grain dryer 10.

Figure 7:
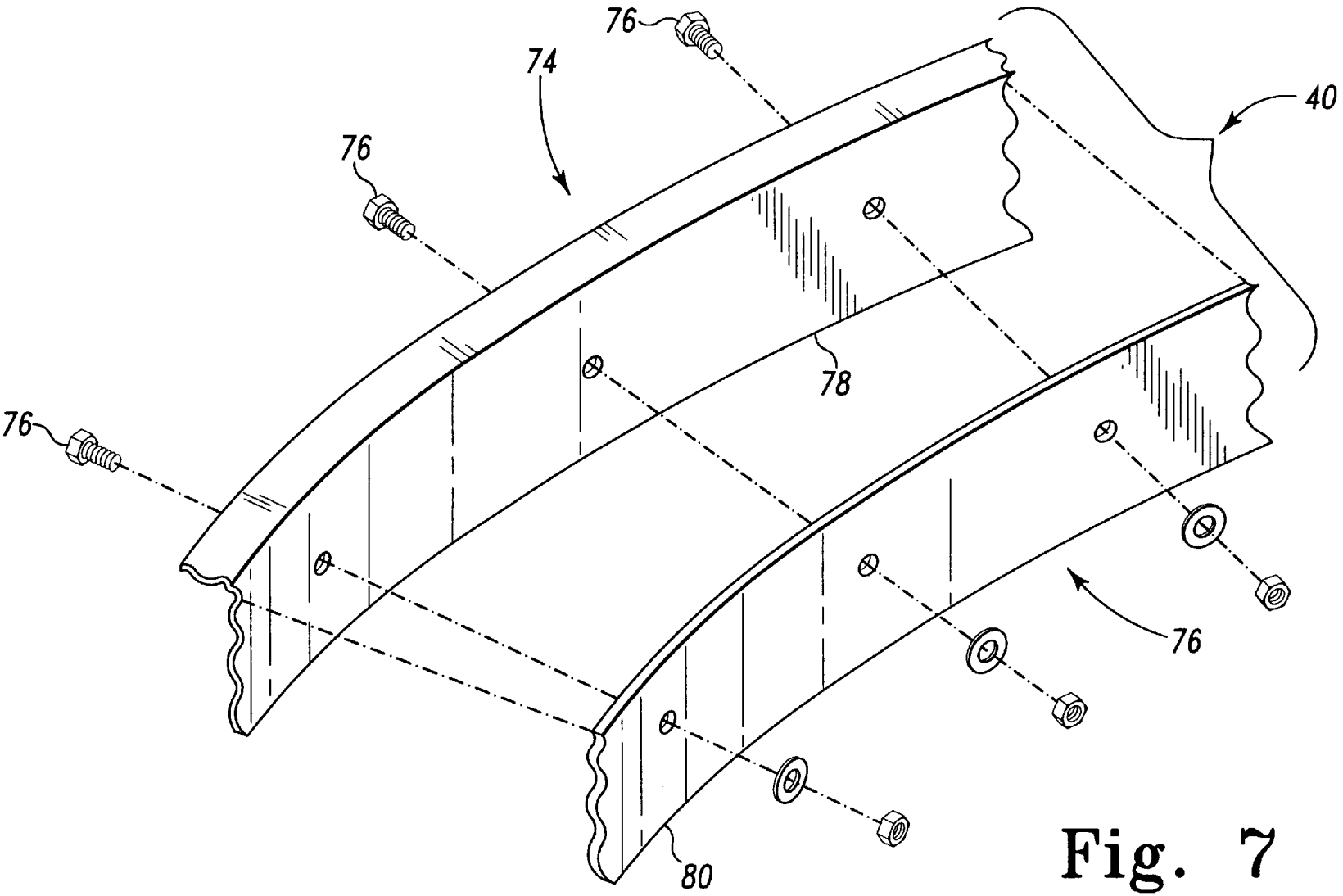
FIG. 7 is an exploded fragmentary view of one of the wipers of the floor sweep assembly of FIG. 6A.
Figure 8A:
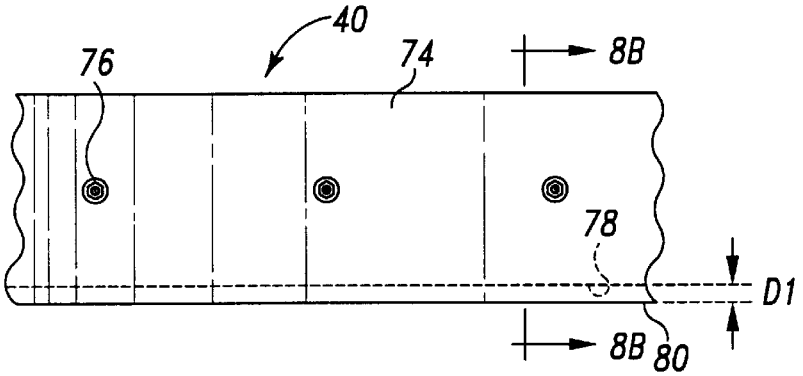
FIG. 8A is a fragmentary side elevational view one of the wipers of FIG. 6A.
Figure 8B:
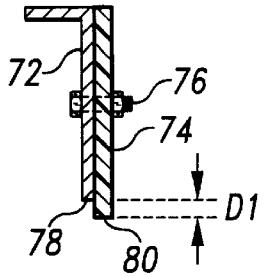
FIG. 8B is a sectional view taken along the line 8B—8B of FIG. 8A as viewed in the direction of the arrows.

The construction of the wipers 40 are shown in more detail in FIGS. 7, 8A, and 8B. In particular, each wiper 40 includes a blade support 72 and a blade 74 which is attached to the blade support 72 with a number of fasteners 76. Each of the blade supports 72 is made from formed steel. In contrast, each of the blades 74 is made from a low friction material, for example, abrasion-resistant, ultra-high molecular weight (uhmw) resin.

The blade support 72 includes a lower edge 78, while the blade 74 includes a lower edge 80. The blade 74 is secured to the blade support 72 such that the lower edge 78 of the blade support 72 is spaced a distance D1 equal to about one quarter inch (¼) vertically above the lower edge 80 of the blade 74 during operation of the grain dryer 10.

Mounting the blade 74 to the blade support 72 in the above-described manner prevents any portion of the blade support 72 from contacting the grain shelf floor 20 during operation of the grain dryer 10. This feature protects the grain shelf floor 20 from being damaged due long term frictional contact between the grain shelf floor 20 and the rotating metallic blade support 72. Note that only the lower edge 80 of the blade 74 contacts the grain shelf floor 20 during rotation of the floor sweep assembly 28. In particular, the lower edge 80 of the blade 74 contacts the grain shelf floor 20 so as to slide across the upper surface of the grain shelf floor 20 as the floor sweep assembly 28 is rotated by the motor 30. Furthermore, this feature reduces the horsepower requirements for the motor 30 of the grain metering system 26 since the blade 74, which is made of a low friction material (e.g. uhmw resin), is the only component of the grain metering system 26 which is contacting the grain shelf floor 20 during rotation of the floor sweep assembly 28.

In addition, since the blade 74 is mounted on a leading edge of the blade support 72 relative to the forward direction of movement 82 of the wiper 40 as depicted in FIG. 9, the blade 74 is advanced into contact with the grain which is supported on the grain floor shelf 20 so as to push the grain horizontally across an upper surface of the grain floor shelf. Since the low friction blade 74 is the primary component which contacts and pushes the grain across the grain floor shelf, a substantially reduced frictional resistance results from this physical contact. This feature is beneficial since it results in a significantly reduced amount of physical trauma to the grain during advancement of the grain from the outer peripheral edges of the grain shelf floor 20 to the hopper 17 during the grain metering process. This feature is additionally beneficial because it further reduces the horsepower requirements for the motor 30 of the grain metering system 26 since the blade 74 which is made of a low friction material (e.g. uhmw resin) is the primary component of the grain metering system 26 which is contacting the grain during rotation of the floor sweep assembly 28.

While the invention has been described in detail in the drawings and foregoing description, the same is to be considered as illustrative and not restrictive in character, it being understood that only the preferred embodiments and methods have been shown and described and that all changes and modifications that come within the spirit of the invention are desired to be protected.

What is claimed is:

1. A grain dryer, comprising:

a wall assembly having (i) an inner wall and an outer wall which defines a grain flow path therebetween, and (ii) a discharge slot defined in said wall assembly through which grain may flow;

a grain shelf floor positioned relative to said wall assembly such that grain flowing through said discharge slot advances onto said grain shelf floor, said grain shelf floor has a hopper opening defined therein; and a floor sweep assembly having a wiper, wherein (i) said wiper includes a blade support and a blade attached to said blade support, (ii) said floor sweep assembly is positioned vertically above said grain shelf floor such that rotation of said floor sweep assembly causes grain positioned on said grain shelf floor to be pushed across an upper surface of said grain shelf floor by said blade until said grain falls through said hopper opening, and (iii) a first lower edge of said blade contacts said grain shelf floor so as to slide across said upper surface of said grain shelf floor as said floor sweep assembly is being rotated, wherein said blade support includes a second lower edge, and wherein said blade is attached to said blade support such that said second lower edge is maintained spaced apart from said grain shelf floor as said first lower edge is slid across said upper surface of said grain shelf floor.

2. A grain dryer, comprising:

a wall assembly having (i) an inner wall and an outer wall which defines a grain flow path therebetween, and (ii) a discharge slot defined in said wall assembly through which grain may flow;

a grain shelf floor positioned relative to said wall assembly such that grain flowing through said discharge slot advances onto said grain shelf floor, said grain shelf floor has a hopper opening defined therein; and a floor sweep assembly having a wiper, wherein (i) said wiper includes a blade support and a blade attached to said blade support, (ii) said floor sweep assembly is positioned vertically above said grain shelf floor such that rotation of said floor sweep assembly causes grain positioned on said grain shelf floor to be pushed across an upper surface of said grain shelf floor by said blade until said grain falls through said hopper opening, and (iii) a first lower edge of said blade contacts said grain shelf floor so as to slide across said upper surface of said grain shelf floor as said floor sweep assembly is being rotated, wherein said floor sweep assembly is rotated in a path of movement so as to define a leading side of said blade support, and wherein said blade is secured to said leading side of said blade support so that rotation of said floor sweep assembly advances said blade into contact with said grain positioned on said grain shelf floor.

3. A floor sweep assembly for advancing grain across a grain shelf floor of a grain dryer, comprising:

a wiper having a blade support and a blade attached to said blade support, wherein (i) rotation of said floor sweep assembly causes grain positioned on said grain shelf floor to be pushed across an upper surface of said grain shelf floor by said blade, and (ii) a first lower edge of said blade contacts said grain shelf floor so as to slide across said upper surface of said grain shelf floor as said floor sweep assembly is being rotated; and a support member, wherein rotation of said support member causes rotation of said wiper, wherein said blade support includes a second lower edge, and wherein said blade is attached to said blade support such that said second lower edge is maintained spaced apart from said grain shelf floor as said first lower edge is slid across said upper surface of said grain shelf floor.

4. A floor sweep assembly for advancing grain across a grain shelf floor of a grain dryer, comprising:

a wiper having a blade support and a blade attached to said blade support, wherein (i) rotation of said floor sweep assembly causes grain positioned on said grain shelf floor to be pushed across an upper surface of said grain shelf floor by said blade, and (ii) a first lower edge of said blade contacts said grain shelf floor so as to slide across said upper surface of said grain shelf floor as said floor sweep assembly is being rotated; and a support member, wherein rotation of said support member causes rotation of said wiper, wherein said floor sweep assembly is rotated in a path of movement so as to define a leading side of said blade support, and wherein said blade is secured to said leading side of said blade support so that rotation of said floor sweep assembly advances said blade into contact with said grain positioned on said grain shelf floor.

* * * * *